US006357748B1

(12) United States Patent
Tomkovich

(10) Patent No.: US 6,357,748 B1
(45) Date of Patent: Mar. 19, 2002

(54) 3-PERSON CHESS BOARD GAME WITH TRIANGULAR-SHAPED GAME BOARD

(76) Inventor: Gregory Tomkovich, 5 Omaha Dr., Cranford, NJ (US) 07016

( * ) Notice: Subject to any disclaimer, the term of this patent is extended or adjusted under 35 U.S.C. 154(b) by 0 days.

(21) Appl. No.: 09/648,135

(22) Filed: Aug. 25, 2000

(51) Int. Cl.[7] ..... A63F 3/02
(52) U.S. Cl. ..... 273/261
(58) Field of Search ..... 273/261

(56) References Cited

U.S. PATENT DOCUMENTS

| | | | |
|---|---|---|---|
| D28,317 | S | 2/1898 | Rackleff |
| 1,373,448 | A | 4/1921 | Precinauskas |
| 3,836,149 | A | 9/1974 | Adams et al. |
| 3,998,464 | A | 12/1976 | Poturalski |
| 4,940,241 | A | 7/1990 | Faraci, Jr. |
| 5,209,488 | A | 5/1993 | Kimball |

FOREIGN PATENT DOCUMENTS

| | | | | |
|---|---|---|---|---|
| GB | 2214092 | * | 8/1989 | ..... 273/261 |

OTHER PUBLICATIONS

"Triss", Hans Mikelson, website: www.chessvariants.com, 1985.*

* cited by examiner

*Primary Examiner*—Benjamin H. Layno

(57) ABSTRACT

A 3-person chess board game for providing a more challenging chess game having three players rather than the traditional two players. The 3-person chess board game includes a triangular-shaped game board having a plurality of triangular-shaped game-piece movement sections displayed upon a top surface of the triangular-shaped game board; and also includes game pieces movably disposed upon the triangular-shaped game board.

6 Claims, 3 Drawing Sheets

3-PERSON CHESS BOARD GAME WITH TRIANGULAR-SHAPED GAME BOARD

BACKGROUND OF THE INVENTION

1. Field of the Invention

The present invention relates to a triangle chess game and more particularly pertains to a new 3-person chess board game for providing a more challenging chess game having three players rather than the traditional two players.

2. Description of the Prior Art

The use of a triangle chess game is known in the prior art. More specifically, a triangle chess game heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,373,448; U.S. Pat. No. 3,998,464; U.S. Pat. No. 4,940,241; U.S. Pat. No. 3,836,149; U.S. Pat. No. 5,209,488; and U.S. Pat. No. Des. 28,317.

While these devices fulfill their respective, particular objectives and requirements, the aforementioned patents do not disclose a new 3-person chess board game. The inventive device includes a triangular-shaped game board having a plurality of triangular-shaped game-piece movement sections displayed upon a top surface of the triangular-shaped game board; and also includes game pieces movably disposed upon the triangular-shaped game board In these respects, the 3-person chess board game according to the present invention substantially departs from the conventional concepts and designs of the prior art, and in so doing provides an apparatus primarily developed for the purpose of providing a more challenging chess game having three players rather than the traditional two players.

SUMMARY OF THE INVENTION

In view of the foregoing disadvantages inherent in the known types of triangle chess game now present in the prior art, the present invention provides a new 3-person chess board game construction wherein the same can be utilized for providing a more challenging chess game having three players rather than the traditional two players.

The general purpose of the present invention, which will be described subsequently in greater detail, is to provide a new 3-person chess board game which has many of the advantages of the triangle chess game mentioned heretofore and many novel features that result in a new 3-person chess board game which is not anticipated, rendered obvious, suggested, or even implied by any of the prior art triangle chess game, either alone or in any combination thereof.

To attain this, the present invention generally comprises a triangular-shaped game board having a plurality of triangular-shaped game-piece movement sections displayed upon a top surface of the triangular-shaped game board; and also includes game pieces movably disposed upon the triangular-shaped game board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new 3-person chess board game which has many of the advantages of the triangle chess game mentioned heretofore and many novel features that result in a new 3-person chess board game which is not anticipated, rendered obvious, suggested, or even implied by any of the prior art triangle chess game, either alone or in any combination thereof.

It is another object of the present invention to provide a new 3-person chess board game which may be easily and efficiently manufactured and marketed.

It is a further object of the present invention to provide a new 3-person chess board game which is of a durable and reliable construction.

An even further object of the present invention is to provide a new 3-person chess board game which is susceptible of a low cost of manufacture with regard to both materials and labor, and which accordingly is then susceptible of low prices of sale to the consuming public, thereby making such 3-person chess board game economically available to the buying public.

Still yet another object of the present invention is to provide a new 3-person chess board game which provides in the apparatuses and methods of the prior art some of the advantages thereof, while simultaneously overcoming some of the disadvantages normally associated therewith.

Still another object of the present invention is to provide a new 3-person chess board game for providing a more challenging chess game having three players rather than the traditional two players.

Yet another object of the present invention is to provide a new 3-person chess board game which includes a triangular-shaped game board having a plurality of triangular-shaped game-piece movement sections displayed upon a top surface of the triangular-shaped game board; and also includes game pieces movably disposed upon the triangular-shaped game board.

Still yet another object of the present invention is to provide a new 3-person chess board game that increases the strategy of the player since the player is now competing with two other players.

Even still another object of the present invention is to provide a new 3-person chess board game that increases the game piece movement possibilities.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
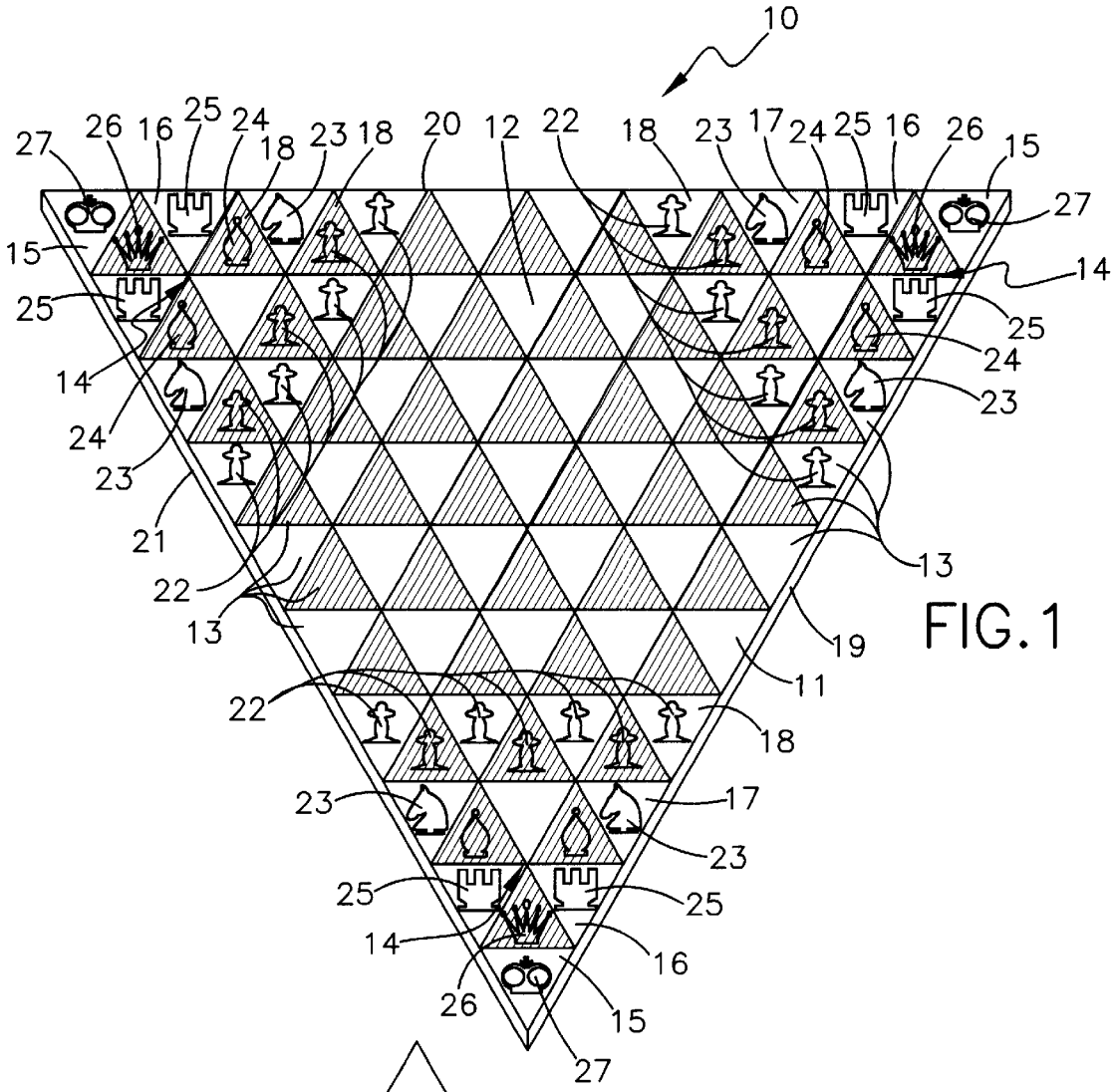
FIG. 1 is a top plan view of a new 3-person chess board game according to the present invention.
Figure 2:
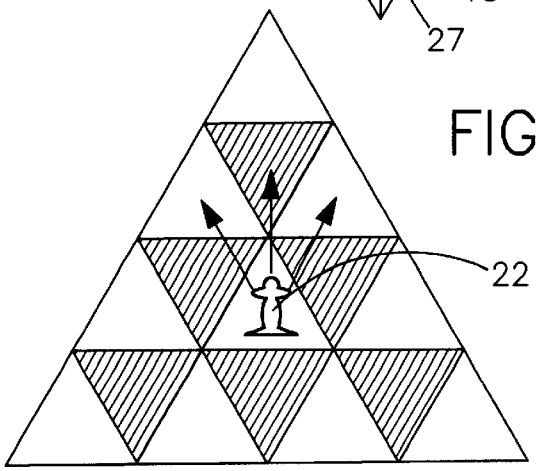
FIG. 2 is a schematic view of moves made by a pawn game piece of the present invention.
Figure 3:
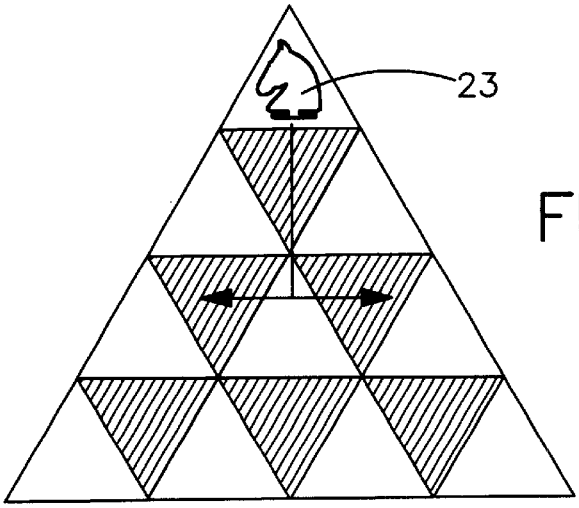
FIG. 3 is a schematic view of moves made by a knight game piece of the present invention.
Figure 4:
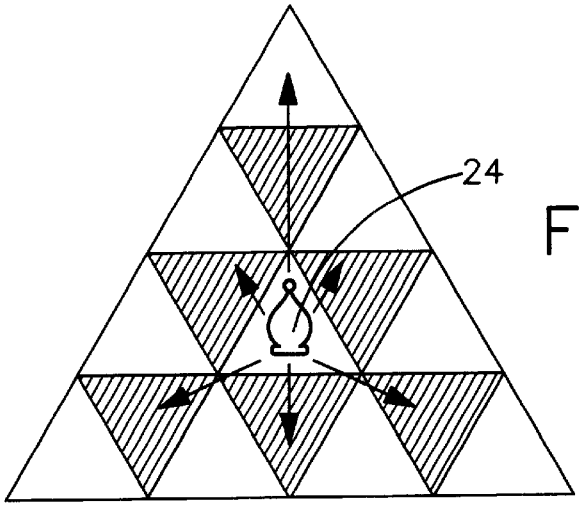
FIG. 4 is a schematic view of moves made by a bishop game piece of the present invention.
Figure 5:
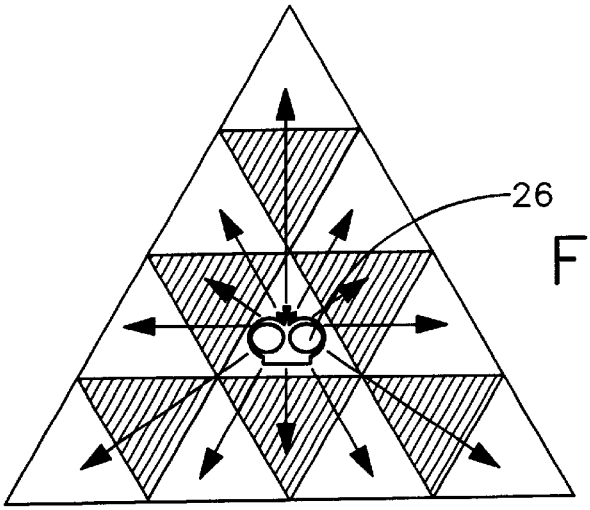
FIG. 5 is a schematic view of moves made by a queen game piece of the present invention.
Figure 6:
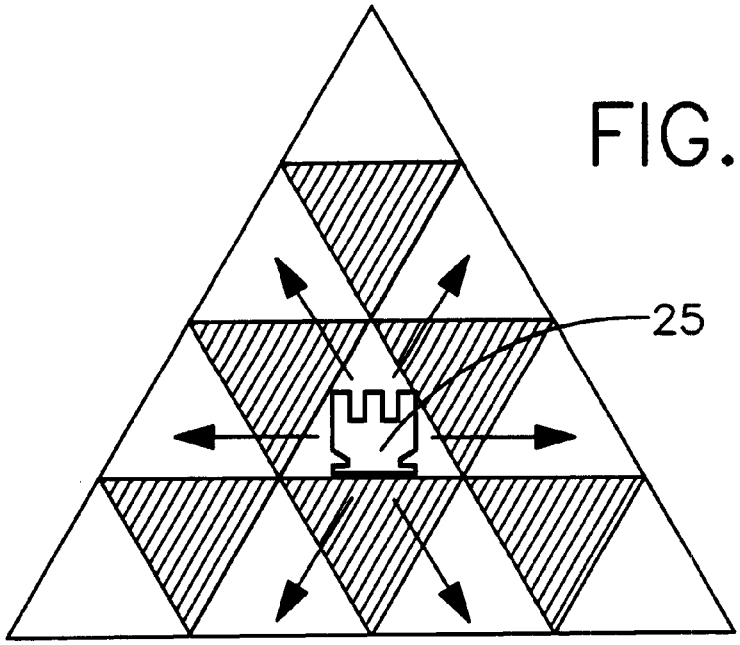
FIG. 6 is a schematic view of moves made by a rook game piece of the present invention.
Figure 7:
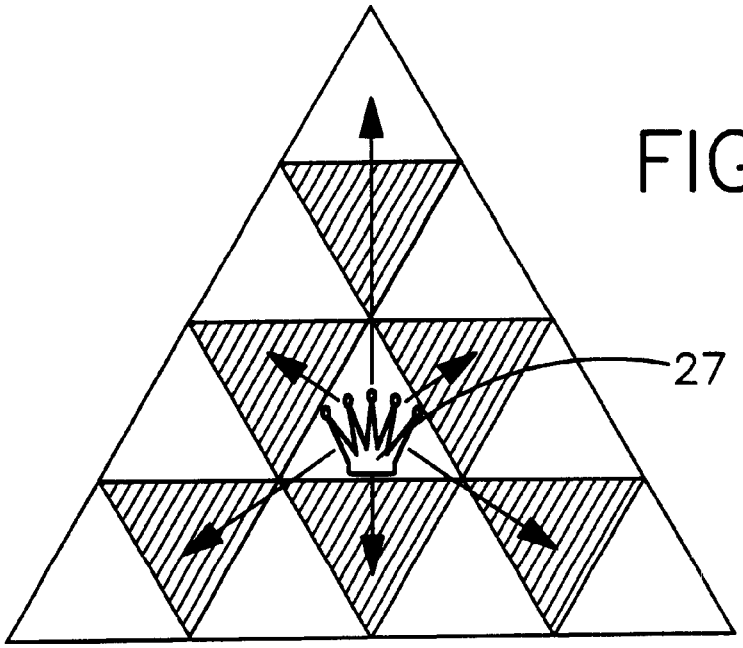
FIG. 7 is a schematic view of moves made by a king game piece of the present invention.

With reference now to the drawings, and in particular to FIGS. 1 through 7 thereof, a new 3-person chess board game embodying the principles and concepts of the present invention and generally designated by the reference numeral 10 will be described.

As best illustrated in FIGS. 1 through 7, the 3-person chess board game 10 generally comprises a triangular-shaped game board 11 having a plurality of triangular-shaped game-piece movement sections 13 displayed upon a top surface 12 of the triangular-shaped game board 11. The triangular-shaped game board includes three game-piece starting position areas 14 disposed in corners thereof. Each of the game-piece starting position areas 14 includes sixteen game-piece movement sections 13 which are arranged in four rows 15–18. The four rows 15–18 of each of the game-piece starting position areas 14 include a first row 15 having one of the game-piece movement sections 13 disposed at a respective vertex of the triangular-shaped game board 11, and also includes a second row 16 having three of the game-piece movement sections 13, and further includes a third row 17 having five of the game-piece movement sections 13, and also includes a fourth row 18 having seven game-piece movement sections 13.

Game pieces 22–27 are movably disposed upon the triangular-shaped game board 11. The game pieces include three sets of the game pieces 22–27 with each set including seven pawns 22, two knights 23, two bishops 24, one queen 26, two rooks 25, and one king 27. Each of the sets of game pieces 22–27 are set up upon a respective game-piece starting position area 14 with the king 27 being movably disposed upon the first row 15 and with the queen 26 and the rooks 25 being movably disposed upon the second row 16 and with the knights 23 and the bishops 24 being movably disposed upon the third row 17 and with the pawns 22 being movably disposed upon the fourth row 18. Each of the pawns 22 is adapted to move toward an opposite side 19–21 of the triangular-shaped game board 11 and to move initially upon one or two of the game-piece movement sections 13 and upon the game-piece movement sections 13 one at a time thereafter. Each of the pawns is capable of diagonally capturing the game pieces 22–27 of the other players. Each of the bishops 24 is adapted to move upon any number of unoccupied game-piece movement sections 13 during a singular move in a direction perpendicular to any side 19–21 of the triangular-shaped game board 11. Each of the knights 23 is adapted to move upon two of the game-piece movement sections 13 during a singular move in a direction perpendicular to any side 19–21 of the triangular-shaped game board 11, and is adapted to move upon one of the game-piece movement sections 13 during a singular move at right angles to the perpendicular direction, and is adapted to jump over one's other game pieces 22–27. Each of the rooks 25 is adapted to move upon any number of unoccupied game-piece movement sections 13 during a singular move in a direction parallel to any side 19–21 of the game board 11. Each queen is adapted to move upon any number of unoccupied game-piece movement sections 13 during a singular move in a direction either parallel or perpendicular to any side 19–21 of the game board 11. Each king is adapted to move in any direction upon the game-piece movement sections one at a time during a singular move, and is adapted to move upon two unoccupied game-piece movement sections 13 during a singular move in a direction parallel to any side 19–21 of the game board 11.

In use, the objective of the game is to checkmate the king 27 of one or both opponents which would result in the game ending. The winner would receive one point, and the checkmated player would receive zero points, and the other player would receive ½ point. If the winner is able to checkmate both kings 27 of the opposing players at the same time, the winner would receive two points and the opponents would receive zero points.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A 3-person chess board game consisting of:

a triangular-shaped game board having a plurality of triangular-shaped game-piece movement sections displayed upon a top surface of said triangular-shaped game board; and game pieces movably disposed upon said triangular-shaped game board, said game pieces include three sets of said game pieces with each said set including seven pawns, two knights, two bishops, one queen, two rooks, and one king.

2. A 3-person chess board game as described in claim 1, wherein said triangular-shaped game board includes three game-piece starting position areas disposed in corners thereof, each of said game-piece starting position areas including sixteen game-piece movement sections which are arranged in four rows.

3. A 3-person chess board game as described in claim 2, wherein said four rows of each of said game-piece starting position areas include a first row having one of said game-piece movement sections disposed at a respective vertex of said triangular-shaped game board, and also include a second row having three of said game-piece movement sections, and further include a third row having five of said game-piece movement sections, and also include a fourth row having seven game-piece movement sections.

4. A 3-person chess board game as described in claim 3, wherein each of said sets of game pieces is set up upon a respective said game-piece starting position area with said king being movably disposed upon said first row and with said queen and said rooks being movably disposed upon said second row and with said knights and said bishops being movably disposed upon said third row and with said pawns being movably disposed upon said fourth row.

5. A 3-person chess board game consisting of:

a triangular-shaped game board having a plurality of triangular-shaped game-piece movement sections displayed upon a top surface of said triangular-shaped game board, said triangular-shaped game board including three game-piece starting position areas disposed in corners thereof, each of said game-piece starting position areas including sixteen game-piece movement sections which are arranged in four rows, said four rows of each of said game-piece starting position areas including a first row having one of said game-piece movement sections disposed at a respective vertex of said triangular-shaped game board, and also including a second row having three of said game-piece movement sections, and further including a third row having five of said game-piece movement sections, and also including a fourth row having seven game-piece movement sections; and game pieces movably disposed upon said triangular-shaped game board, said game pieces including three sets of said game pieces with each said set including seven pawns, two knights, two bishops, one queen, two rooks, and one king, each of said sets of game pieces being set up upon a respective said game-piece starting position area with said king being movably disposed upon said first row and with said queen and said rooks being movably disposed upon said second row and with said knights and said bishops being movably disposed upon said third row and with said pawns being movably disposed upon said fourth row, said bishops being positioned between said knights, a central one of each of said game-piece movement sections of said third rows being left unoccupied, each of said pawns being adapted to move toward an opposite side of said triangular-shaped game board and to move initially upon one or two of said game-piece movement sections and upon said game-piece movement sections one at a time thereafter, each of said pawns capable of diagonally capturing said game pieces of the other players, each of said bishops being adapted to move upon any number of unoccupied said game-piece movement sections in a direction perpendicular to any said side of said triangular-shaped game board, each of said knights being adapted to move upon two of said game-piece movement sections in a direction perpendicular to any said side of said triangular-shaped game board, and being adapted to move upon one of said game-piece movement sections at right angles to said perpendicular direction, and being adapted to jump over one's other said game pieces, each of said rooks being adapted to move upon any number of unoccupied said game-piece movement sections in a direction parallel to any side of said game board, each said queen being adapted to move upon any number of unoccupied said game-piece movement sections in a direction either parallel or perpendicular to any said side of said game board, each said king being adapted to move in any direction upon said game-piece movement sections one at a time, and is adapted to move upon two unoccupied said game-piece movement sections in a direction parallel to any side of said game board.

6. A method of playing a 3-person chess board game comprising:

providing a triangular-shaped game board having a plurality of triangular-shaped game-piece movement sections displayed upon a top surface of said triangular-shaped game board and game pieces, said game pieces including three sets of said game pieces with each said set including seven pawns, two knights, two bishops, one queen, two rooks, and one king, said triangular-shaped game board including three game-piece starting position areas disposed in corners of said game board, each of said game-piece starting position areas including sixteen game-piece movement sections which are arranged in four rows, said four rows of each of said game-piece starting position areas including a first row having one of said game-piece movement sections disposed at a respective vertex of said triangular-shaped game board, and also including a second row having three of said game-piece movement sections, and further including a third row having five of said game-piece movement sections, and also include a fourth row having seven game-piece movement sections;

setting each of said sets of game pieces upon a respective said game-piece starting position area with said king being movably disposed upon said first row and with said queen and said rooks being movably disposed upon said second row and with said knights and said bishops being movably disposed upon said third row and with said pawns being movably disposed upon said fourth row, said bishops being positioned between said knights, a central one of each of said game-piece movement sections of said third rows being left unoccupied;

moving each of said pawns toward an opposite side of said triangular-shaped game board and initially onto one or two of said game-piece movement sections and onto one of said game-piece movement sections one at a time thereafter;

diagonally capturing said game pieces of the other players by said pawns;

moving said bishops onto any number of unoccupied said game-piece movement sections during a singular move in a direction perpendicular to any said side of said triangular-shaped game board;

moving said knights onto two of said game-piece movement sections during a singular move in a direction perpendicular to any said side of said triangular-shaped game board and moving said knights onto one of said game-piece movement sections during a singular move at right angles to said perpendicular direction wherein said knights may over another player's said game pieces;

moving said rooks onto any number of unoccupied said game-piece movement sections during a singular move in a direction parallel to any side of said game board;

moving said queens onto any number of unoccupied said game-piece movement sections during a singular move in a direction either parallel or perpendicular to any said side of said game board; and moving said kings in any direction onto said game-piece movement sections one at a time, and moving said kings onto two unoccupied said game-piece movement sections during a singular move in a direction parallel to any side of said game board.

* * * * *